US010329925B2

(12) United States Patent
Voleti et al.

(10) Patent No.: US 10,329,925 B2
(45) Date of Patent: Jun. 25, 2019

(54) VIBRATION-DAMPED COMPOSITE AIRFOILS AND MANUFACTURE METHODS

(71) Applicant: United Technologies Corporation, Hartford, CT (US)

(72) Inventors: Sreenivasa R. Voleti, Farmington, CT (US); Christopher M. Quinn, Middletown, CT (US)

(73) Assignee: United Technologies Corporation, Farmington, CT (US)

( * ) Notice: Subject to any disclaimer, the term of this patent is extended or adjusted under 35 U.S.C. 154(b) by 624 days.

(21) Appl. No.: 14/903,076

(22) PCT Filed: Jun. 26, 2014

(86) PCT No.: PCT/US2014/044340

§ 371 (c)(1),
(2) Date: Jan. 6, 2016

(87) PCT Pub. No.: WO2015/009425

PCT Pub. Date: Jan. 22, 2015

(65) Prior Publication Data

US 2016/0130952 A1 May 12, 2016

Related U.S. Application Data

(60) Provisional application No. 61/846,306, filed on Jul. 15, 2013.

(51) Int. Cl.
*F01D 5/16* (2006.01)
*F01D 5/26* (2006.01)
(Continued)

(52) U.S. Cl.
CPC ..... *F01D 5/26* (2013.01); *F01D 5/16* (2013.01); *F01D 5/282* (2013.01); *F01D 9/041* (2013.01);
(Continued)

(58) Field of Classification Search
CPC ..... F01D 5/26; F01D 5/282; F01D 5/16
See application file for complete search history.

(56) References Cited

U.S. PATENT DOCUMENTS 6,769,866 B1 8/2004 Kannefass et al.
7,736,131 B1 * 6/2010 Wilson, Jr. ..... B82Y 30/00 416/226
(Continued)

FOREIGN PATENT DOCUMENTS

JP 2002-539350 A 11/2002
WO 2010084320 A2 7/2010

OTHER PUBLICATIONS

Carbon Fiber—Wikipedia, retrieved from https://web.archive.org/web/20100124113424/https://en.wikipedia.org/wiki/Carbon_fibers, Jan. 2010.*
(Continued)

*Primary Examiner* — Woody A Lee, Jr.
(74) *Attorney, Agent, or Firm* — Bachman & LaPointe, P.C.

(57) ABSTRACT

A turbine engine component (100) comprises a fiber structure (125, 126) forming at least a portion of an airfoil (102). A matrix (128) embeds the fiber structure. A carbon nanotube filler (130) is in the matrix.

22 Claims, 3 Drawing Sheets

(51) Int. Cl.

| | |
|---|---|
| ***F04D 29/02*** | (2006.01) |
| ***F04D 29/32*** | (2006.01) |
| ***F01D 5/28*** | (2006.01) |
| ***F01D 9/04*** | (2006.01) |

(52) U.S. Cl.
CPC ..... *F04D 29/023* (2013.01); *F04D 29/324* (2013.01); *F05D 2220/32* (2013.01); *F05D 2230/30* (2013.01); *F05D 2240/12* (2013.01); *F05D 2240/30* (2013.01); *F05D 2300/224* (2013.01); *F05D 2300/603* (2013.01); *F05D 2300/614* (2013.01)

(56) References Cited

U.S. PATENT DOCUMENTS

2004/0092330 A1 5/2004 Meyer et al.
2007/0128960 A1* 6/2007 Ghasemi Nejhad ... B82Y 30/00 442/59
2007/0292274 A1 12/2007 Burdgick et al.
2008/0170943 A1 7/2008 Cairo et al.
2008/0310965 A1* 12/2008 Gerakis ..... F01D 5/147 416/97 R
2009/0152009 A1 6/2009 Slay et al.
2009/0289232 A1* 11/2009 Rice ..... F01D 17/20 252/511
2011/0052382 A1 3/2011 Cheung
2011/0052405 A1 3/2011 Parkin
2012/0070270 A1 3/2012 Ravey et al.
2012/0134838 A1 5/2012 Ramirez Jimenez et al.
2012/0167390 A1 7/2012 Rice
2012/0189846 A1 7/2012 Shah et al.
2012/0321443 A1 12/2012 Ravey et al.
2013/0004324 A1 1/2013 Hansen et al.
2013/0034447 A1 2/2013 Nordin et al.
2013/0045369 A1 2/2013 Takemura et al.
2013/0344314 A1* 12/2013 Shokri ..... B05D 1/04 428/221
2014/0326058 A1* 11/2014 Broughton ..... G01M 15/14 73/112.01
2015/0050159 A1* 2/2015 Caldeira ..... F01D 5/147 416/96 R

OTHER PUBLICATIONS

CYCOM 5250-4 datasheet, Cytec Engineered materials, Mar. 2011.*
International Search Report and Written Opinion for PCT/US2014/044340, dated Oct. 21, 2014.
European Search Report dated Feb. 7, 2017 for EP Patent Application No. 14826032.6.

* cited by examiner

VIBRATION-DAMPED COMPOSITE AIRFOILS AND MANUFACTURE METHODS

CROSS REFERENCE TO RELATED APPLICATION

Benefit is claimed of U.S. Patent Application Ser. No. 61/846,306, filed Jul. 15, 2013, and entitled "Vibration-Damped Composite Airfoils and Manufacture Methods", the disclosure of which is incorporated by reference herein in its entirety as if set forth at length.

BACKGROUND

The disclosure relates to damping of gas turbine engine components. More particularly, the disclosure relates to damping of fan blades of turbofan engines.

Gas turbine engine components are subject to vibrational loads. One particular component is fan blades of a turbofan engine.

US Patent Application Publication 2013/0004324 discloses use of a carbon fiber fan blade airfoil body with a metallic leading edge sheath. US Patent Application Publication 2012/0070270 discloses a vibration dampener for vane structures containing carbon nanotubes. US Patent Application Publication 2012/0321443 discloses a vibration-damping rotor casing component containing carbon nanotubes.

In other fields, various patent applications reference the presence of nanotubes in composites. These include US Patent Application Publications 2012/0134838, 2012/0189846, 2013/0034447, 2009/0152009, 2004/0092330, 2007/0128960, and 2013/0045369 and International Application Publication WO2010/084320.

SUMMARY

One aspect of the disclosure involves a turbine engine component comprises a fiber structure forming at least a portion of an airfoil. A matrix embeds the fiber structure. A carbon nanotube filler is in the matrix.

A further embodiment may additionally and/or alternatively include the carbon nanotube filler in the matrix existing through a thickness of at least three plies of the fiber structure.

A further embodiment may additionally and/or alternatively include the fiber structure forming at least 30% by volume of a composite portion of the component.

A further embodiment may additionally and/or alternatively include the fiber structure forming 45-65% by volume of a composite portion of the component.

A further embodiment may additionally and/or alternatively include the airfoil being an airfoil of a turbine engine blade.

A further embodiment may additionally and/or alternatively include the airfoil being an airfoil of a turbofan engine fan blade.

A further embodiment may additionally and/or alternatively include the airfoil being an airfoil of a turbine engine vane.

A further embodiment may additionally and/or alternatively include the airfoil being an airfoil of a turbofan engine fan vane.

A further embodiment may additionally and/or alternatively include the fiber structure comprising at least 50% carbon fiber by weight.

A further embodiment may additionally and/or alternatively include the fiber structure comprising one or more woven members.

A further embodiment may additionally and/or alternatively include the matrix comprising a cured resin.

A further embodiment may additionally and/or alternatively include the carbon nanotube filler having a content of 0.05-0.49% in the matrix by weight.

A further embodiment may additionally and/or alternatively include the carbon nanotube filler having a characteristic diameter of 0.5 nanometer to 5 nanometers and the carbon nanotube filler having a characteristic length of 10 nanometers to 100 nanometers.

A further embodiment may additionally and/or alternatively include the carbon nanotube filler in the matrix is in a multi-ply thickness of the fiber structure, inter-ply and intra-ply.

A further embodiment may additionally and/or alternatively include the carbon nanotube filler in the matrix being in a jacket and a core of the fiber structure.

A further embodiment may additionally and/or alternatively include a method for manufacturing the component The method comprises adding a mixture of the carbon nanotube filler and a precursor of the matrix to the fiber structure or a precursor thereof.

A further embodiment may additionally and/or alternatively include positioning the fiber structure in a mold.

A further embodiment may additionally and/or alternatively include the adding comprising injecting said mixture into the mold.

A further embodiment may additionally and/or alternatively include the adding comprising applying the mixture to pre-impregnate a sheet, a tape or a tow.

A further embodiment may additionally and/or alternatively include a method for using the component. The method comprises: placing the component on a gas turbine engine; and running the engine, wherein the carbon nanotube filler damps vibration of the component.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
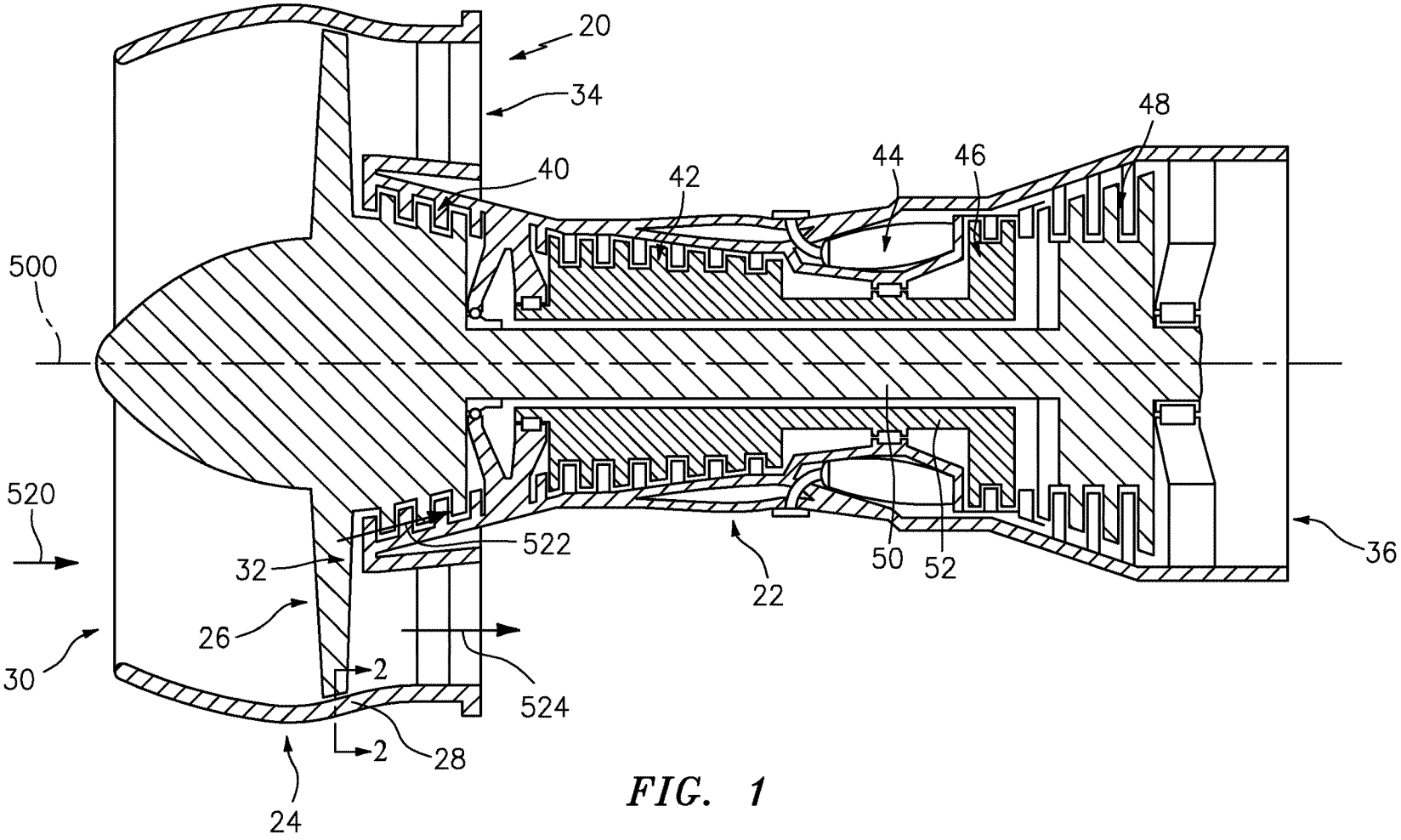
FIG. 1 is a partially schematic half-sectional view of a turbofan engine.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages 32 of fan blades. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also drives the fan. In the exemplary implementation, the fan is driven via a transmission (not shown, e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

Figure 2:
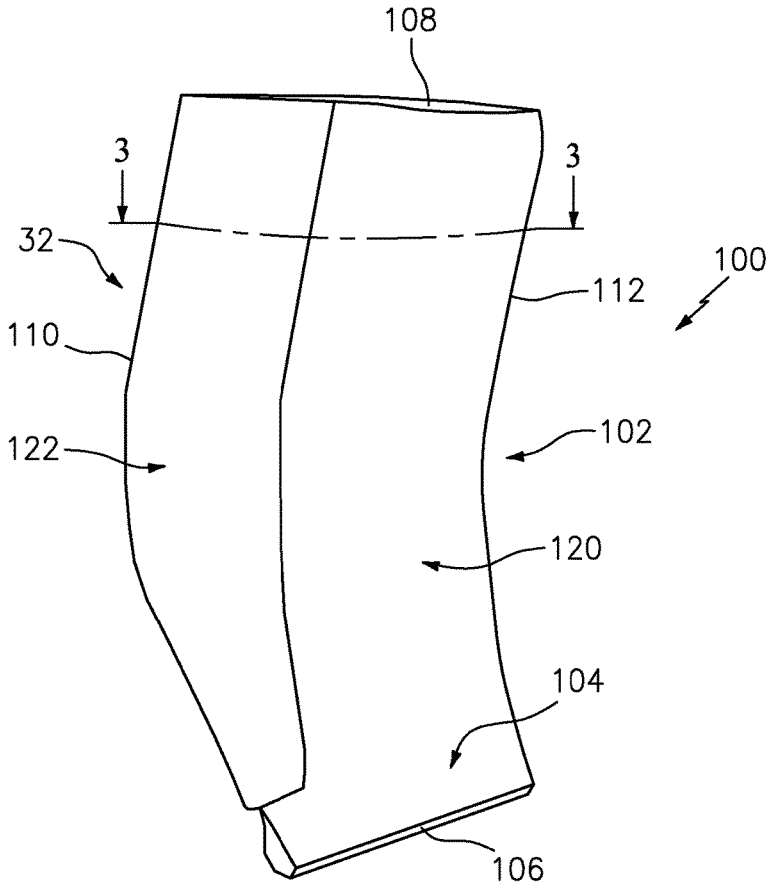
FIG. 2 is a view of a fan blade of the engine of FIG. 1.

FIG. 2 shows a fan blade 100. The blade has an airfoil 102 extending spanwise outward from an inboard end 104 at an attachment root 106 to a tip 108. The airfoil has a leading edge 110, trailing edge 112, pressure side 114 (FIG. 3) and suction side 116. The blade, or at least a portion of the airfoil is formed of a fiber composite. Exemplary fiber is carbon fiber. Exemplary matrix is hardened resin.

In the exemplary blade, the fiber composite portion forms a main body 120 of the airfoil and overall blade to which a leading edge sheath 122 is secured. Exemplary leading edge sheathes are metallic such as those disclosed in US Patent Application Publication 2003/0004324A1, entitled "Nano-Structured Fan Airfoil Sheath" (hereafter the '324 publication). Although the exemplary illustrated configuration is based upon that of the '324 publication, other configurations of blades and other articles are possible. Other airfoil articles include other cold section components of the engine including fan inlet guide vanes, fan exit guide vanes, compressor blades, and compressor vanes or other cold section vanes or struts.

Figure 3:
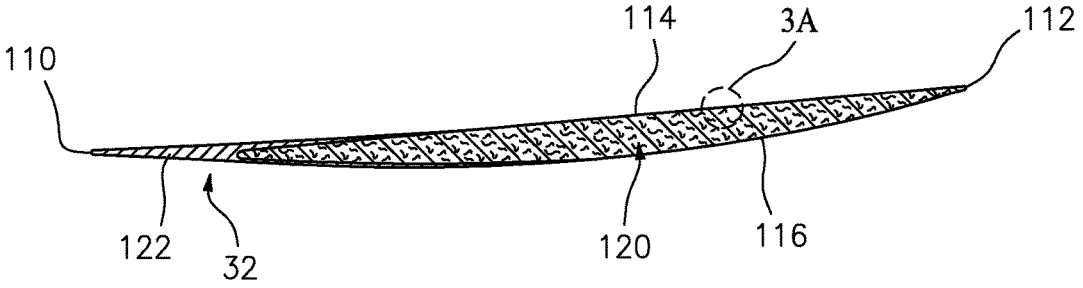
FIG. 3 is a sectional view of the blade of FIG. 2, taken along line 3-3.
Figure 3A:
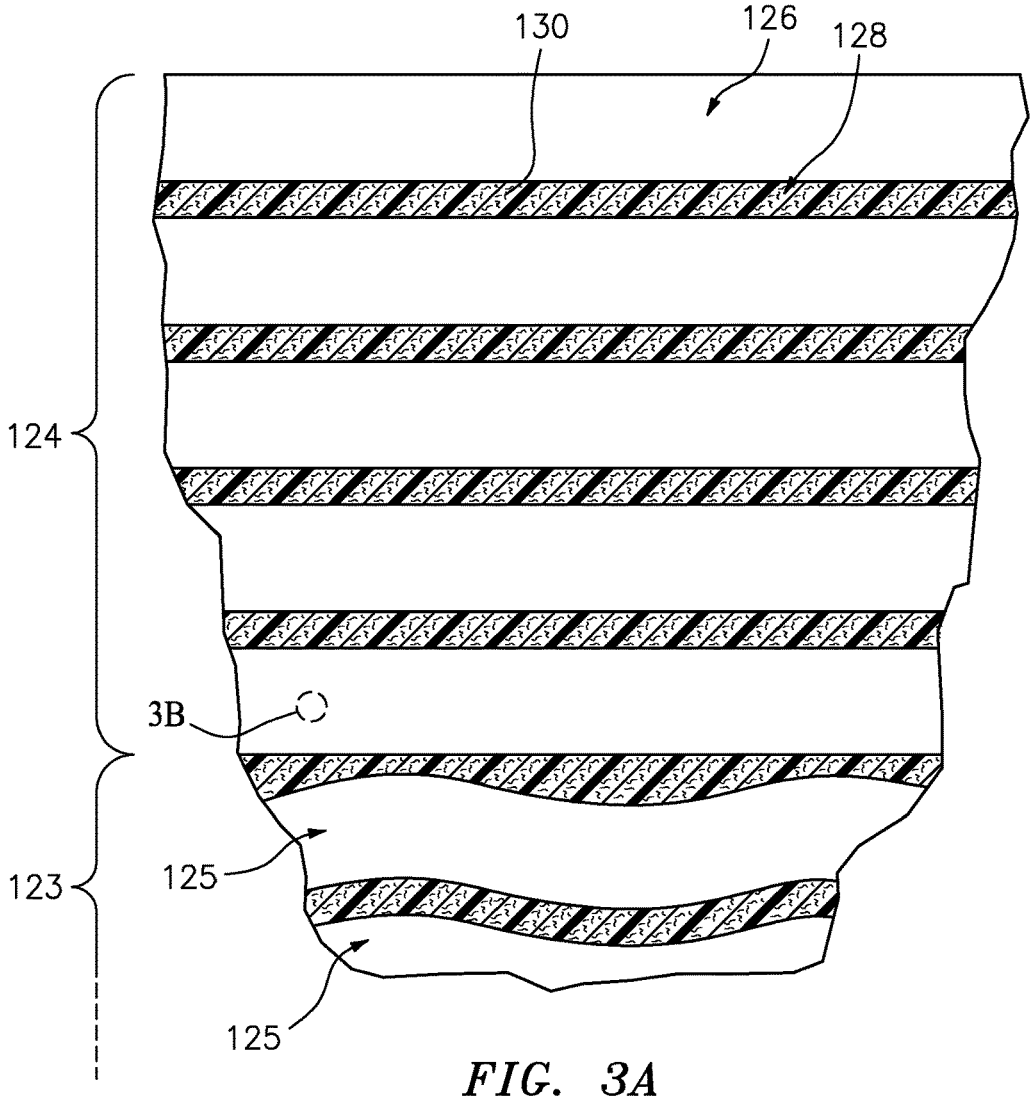
FIG. 3A is an enlarged view of the blade of FIG. 3.

FIG. 3 is a sectional view of the blade of FIG. 2. FIG. 3A is an enlarged view of the blade of FIG. 3. The exemplary fiber composite portion comprises a core 123 and a jacket or envelope 124. The exemplary core 123 is formed of multiple plies 125 of fiber (e.g., carbon fiber). Exemplary core plies are or include woven plies. The exemplary jacket 124 comprises plies 126 of fiber differing in composition or form or arrangement from those of the core. This may also be a carbon fiber. The exemplary jacket 124 comprises five plies of carbon uni-directional (UD) tape, as a specific instance of a particular ply architecture and layup i.e. [0/90/0/90]. Other layups e.g. [0/+45/−45/90] or [0/+60/−60/90] may also be used. Other ply architectures e.g. 2D and 3D weaves can also be used in place of UD tape. Other structures may have three or more or four or more ply thickness (e.g., both core and jacket).

FIG. 3A shows (not to scale in order to illustrate structure) the matrix material as 128. Actual inter-ply thickness of the matrix would be much smaller than shown.

The exemplary carbon fiber forms at least 30% of the composite portion body 120 or blade 100, more particularly, 45-60% or at least 45-70% by volume (fiber volume fraction). Exemplary composite is at least 30% of the overall article (e.g., allowing metallic features such as the sheath), more particularly, at least 50% or at least 60% by weight.

Figure 3B:
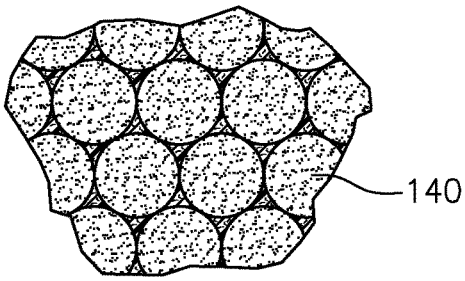
FIG. 3B is a further enlarged view of a ply of the blade of FIG. 3A.

As is discussed further below, the matrix material 128 contains a carbon nanotube (CNT) filler 130. The filler serves to increase vibrational damping. Again, this is not to scale as the carbon nanotubes would be invisible if at the scale of ply thickness shown. FIG. 3B is a partial sectional view of an individual ply 125 or 126 showing matrix and CNT filler infiltrated into the plies and surrounding individual fibers 140 of the ply. Again, this is not to scale relative to the FIG. 3A callout.

Exemplary CNT concentration in the composite is at about 0.1-4.0% by weight, more particularly, 0.1-2.0% by weight, more particularly, 0.1-1.5% by weight. Exemplary characteristic (e.g., mean, median, or mode) CNT diameter is 1 nanometer, more broadly, 0.5 nanometers to 2 nanometers or 0.5 nanometers to 5 nanometers. Exemplary characteristic (e.g., mean, median, or mode) CNT length is 20 nanometers, more broadly, 10 nanometers to 50 nanometers or 10 nanometers to 100 nanometers.

In an exemplary sequence of manufacture, sheets of woven carbon fiber are placed in a mold in a lay-up process. The core may have been separately formed or may be formed as part of a single lay-up process. Uncured matrix material containing the CNTs is then injected into the mold (e.g., in a resin transfer molding (RTM) or vacuum assisted resin transfer molding (VARTM) process).

In an exemplary sequence of manufacture, the CNTs are mixed along with the mixing of resin and hardener (and catalyst or other additive, if any). Exemplary CNT concentration in the uncured matrix prior to injection is at least 0.05% by weight, more particularly, 0.05-0.49%, more particularly, 0.12-0.24%.

In alternative manufacture sequence, the carbon fiber sheet may be a prepreg., preimpregnated with the resin and CNTs. Similar prepreg. tapes or tows may be used in fiber-placed processes.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A turbine engine component (100) comprising:

a fiber structure (125, 126) forming at least a portion of an airfoil of a blade or stator vane;

a matrix (128) embedding the fiber structure; and a carbon nanotube filler (130) in the matrix, wherein the carbon nanotube filler (130) in the matrix is in a multi-ply thickness of the fiber structure, inter-ply and intra ply.

2. The component of claim 1 wherein:

the carbon nanotube filler (130) in the matrix exists through a thickness of at least 3 plies of the fiber structure.

3. The component of claim 1 wherein:

the fiber structure forms at least 30% by volume of a composite portion of the component.

4. The component of claim 3 wherein:

the fiber structure forms 45-65% by volume of a composite portion of the component.

5. The component of claim 1 wherein: the fiber structure forms the portion of the airfoil of the blade.

6. The component of claim 1 wherein: the fiber structure forms the blade as a turbofan engine fan blade.

7. The component of claim 1 wherein: the fiber structure forms the portion of the airfoil of the stator vane.

8. The component of claim 1 wherein the fiber structure forms the vane as a turbofan engine fan vane.

9. The component of claim 1 wherein:

the fiber structure comprises at least 50% carbon fiber by weight.

10. The component of claim 1 wherein:

the fiber structure comprises one or more woven members.

11. The component of claim 1 wherein:

the matrix comprises a cured resin.

12. The component of claim 1 wherein:

the carbon nanotube filler has a content of 0.05-0.49% in the matrix by weight.

13. The component of claim 1 wherein:

the carbon nanotube filler has a characteristic diameter of 0.5 nanometer to 5 nanometers; and the carbon nanotube filler has a characteristic length of 10 nanometers to 100 nanometers.

14. The component of claim 1 wherein:

the carbon nanotube filler (130) in the matrix is in a jacket (124) and a core (123) of the fiber structure;

the core comprising multiple plies of fiber; and the jacket comprising multiple plies of fiber differing in composition or form from the plies of the core.

15. The component of claim 14 wherein the core plies comprise woven plies and the jacket plies comprise unidirectional tape.

16. A method for manufacturing the component of claim 1, the method comprising:

adding a mixture of the carbon nanotube filler and a precursor of the matrix to the fiber structure or a precursor thereof.

17. The method of claim 16 further comprising:

positioning the fiber structure in a mold.

18. The method of claim 17 wherein:

the adding comprises injecting said mixture into the mold.

19. The method of claim 16 wherein:

the adding comprises applying the mixture to pre-impregnate a sheet, a tape or a tow.

20. A method for using the component of claim 1, the method comprising:

placing the component on a gas turbine engine; and running the engine, wherein the carbon nanotube filler damps vibration of the component.

21. A method for manufacturing a turbine engine component, the turbine engine component comprising:

a fiber structure (125, 126) forming at least a portion of an airfoil (102);

a matrix (128) embedding the fiber structure; and a carbon nanotube filler (130) in the matrix, the method comprising:

positioning the fiber structure or a precursor thereof in a mold; and after the positioning, injecting into the mold a mixture of the carbon nanotube filler and a precursor of the matrix.

22. The method of claim 21 wherein the injecting is in a resin transfer molding (RTM) or vacuum assisted resin transfer molding (VARTM) process.

* * * * *